US005809729A

United States Patent [19]

Mitchell

[11] Patent Number: 5,809,729

[45] Date of Patent: Sep. 22, 1998

[54] METHOD AND APPARATUS FOR WALL CONSTRUCTION

[75] Inventor: Everett Lee Mitchell, Evergreen, Colo.

[73] Assignee: Elward Systems Corporation, Lakewood, Colo.

[21] Appl. No.: 611,481

[22] Filed: Mar. 5, 1996

[51] Int. Cl.[6] ..... E04B 2/90

[52] U.S. Cl. ..... 52/474; 52/395; 52/506.01; 52/396.1; 52/766; 52/762; 52/745.19

[58] Field of Search ..... 52/474, 395, 476, 52/766, 762, 506.01, 506.05, 506.06, 506.1, 745.19, 745.05, 396.1

[56] References Cited

U.S. PATENT DOCUMENTS

| | | | |
|---|---|---|---|
| 754,888 | 3/1904 | Pease . | |
| 2,414,628 | 1/1947 | Battin . | |
| 3,210,808 | 10/1965 | Creager . | |
| 3,429,090 | 2/1969 | Metelnick . | |
| 3,436,885 | 4/1969 | Rothermel . | |
| 3,608,264 | 9/1971 | Jones et al. | 52/506.1 |
| 3,736,717 | 6/1973 | Farley | 52/476 |
| 3,973,368 | 8/1976 | Moeller | 52/476 |
| 4,053,008 | 10/1977 | Baslow | 52/476 X |
| 4,057,947 | 11/1977 | Oide . | |
| 4,070,806 | 1/1978 | Hubbard | 52/395 X |
| 4,344,267 | 8/1982 | Sukolics . | |
| 5,095,676 | 3/1992 | Mühle . | |
| 5,184,440 | 2/1993 | Felix et al. | 52/476 X |
| 5,444,945 | 8/1995 | Goodwin | 52/506.06 X |

*Primary Examiner*—Wynne E. Wood
*Attorney, Agent, or Firm*—Sheridan Ross PC; Douglas W. Swartz; Thomas R. Marsh

[57] ABSTRACT

The present invention is directed to an apparatus and method for attaching panel members to perimeter framing members to form a wall. The apparatus attaches the perimeter framing members to the panel member by an attachment member located between a surface of the panel member and a wall of a pocket of the perimeter framing member. To receive the attachment member, which is an elongated rod, the panel member and perimeter framing member form an elongated passage.

28 Claims, 13 Drawing Sheets

METHOD AND APPARATUS FOR WALL CONSTRUCTION

FIELD OF THE INVENTION

The present invention is directed generally to apparatus and methods for constructing walls and specifically to perimeter framing members for attaching panel members to structural members.

BACKGROUND OF THE INVENTION

The exterior walls of many commercial and industrial buildings are formed by mounting a number of panel members and attached perimeter extrusions on a grid framework of structural members attached to the building. The resulting grid of panel members are aesthetically attractive and protect the building structure from fluids in the terrestrial environment.

There are several commonly used configurations to mount the panels members and attached perimeter extrusions to the structural members. In one configuration depicted in FIG. 1, the perimeter extrusion 50*a* forms a channel 62*a* for receiving the panel member 54. The perimeter extrusion 50*a* is held in position by a perimeter extrusion 50*b* of an adjacent panel member which is in turn attached to a structural member (not shown). One or more screws 58, 58*a*, 58*b* and/or a sealant/ adhesive 66 together hold the panel member 54 in the channel 62*a*. The sealant/adhesive 66 also prevents the migration of terrestrial fluids, such as water and air along the interface between the channel 62*a* and panel member to the area behind the panel members. Referring to Fig. 1A, the panel member 54 in another configuration is attached to the perimeter extrusion 50*b* by a continuous edge grip 51, optional screw 58*c*, and sealant/adhesive 66. In yet another configuration shown in FIG. 1B, the panel member 54 is attached to the perimeter extrusion 50*c* by a channel 62*b* and optional screw 58*d* and sealant/adhesive 66. In a further configuration shown in Fig. 1C, the panel member 54 is attached to the perimeter extrusion 50*d* simply by an optional screw 58*c* and sealant/adhesive 66. These configurations can all be used in a "dry system," which employs a gasket between adjacent panel members to inhibit air and water penetration behind the panel members, or a "wet system," which uses a sealant between the adjacent panel members to inhibit air and water penetration. Problems with these configurations are the relative high cost to attach the panel members to the perimeter extrusions and the high rate of panel failure if any of the attachments are faulty or contaminated. The cost to assemble and install the components is relatively high because of the use of mechanical fasteners, such as the screw 58 to attach the panel member to the perimeter extrusion, the use of excessive amounts of expensive sealants/adhesives to bond the panel member to the perimeter extrusion, and/or the use of a continuous edge grip 51 to attach the panel member to the perimeter extrusion. Due to thermal expansion and contraction of the various components, the panel members have been known to detach from the perimeter framing member.

FIG. 2 depicts another commonly used configuration for dry or wet systems. The perimeter extrusion 50*e* is attached to the panel member 54 by means of a channel 62*c* and screw 58. Sealant 66 is applied at several locations to inhibit air and water migration along the channel 62*c*, or screw 58 into the area behind the panel member 54. Like the prior configuration, this configuration suffers from relatively high costs because of the use of mechanical fasteners and the need to apply a sealant to the heads of the fasteners and at several other locations.

FIG. 3 depicts a third configuration for wet systems (but not dry systems) disclosed in U.S. Pat. 4,344,267 to Sukolics. The configuration uses a sealant 66 and a foam or sponge-type backing material 74 to seal the joint 78 between the panel members from penetration by air and water. The configuration uses a perimeter extrusion 70 having two ridges 82*a,b* received in matching grooves 86*a,b* in the adjacent panel members 54*a,b* and an insert 90 to hold the panel members in position. The Sukolics configuration has several disadvantages. The panel members can potentially fail because the perimeter extrusion 70 is stationary and thereby causes the panel member to bend and warp in response to thermal expansions and contractions of the panel member. The thermal expansions and contractions apply additional stress at the panel member corners which can lead to panel failure. The Sukolics configuration can be costly. Because each side of the panel member is fixed in position, the panel members must be cut precisely with an extremely low tolerance to permit the perimeter extrusion 70 to be attached to the gridwork of structural members on the wall. Imprecise measurements or cuts can cause panel members and perimeter extrusions to be discarded. Finally, the Sukolics system is labor intensive to install. The system requires the perimeter extrusions to be attached to the structural members either before attachment of the panel members and inserts (which as a result are more difficult to attach) or after attachment of the panel members and inserts if the panel member is screwed to the perimeter extrusions (which is a labor intensive step).

SUMMARY OF THE INVENTION

It is an objective of the present invention to provide an inexpensive method and apparatus for attaching panel members to perimeter framing members. As used herein, "perimeter framing member" includes any type of retaining bracket for panel members including all types of perimeter extrusions or formed pieces. Related objectives are to provide a method and apparatus that minimizes or entirely eliminates the use of mechanical fasteners, such as screws and bolts, and/or that tolerates imprecision in panel member measurements and cuts during assembly.

Another objective is to provide e a method and apparatus for attaching a panel member to perimeter framing members that has a significantly reduced incidence of panel member and/or perimeter framing member failure compared to existing systems. A related objective is to provide an inexpensive method and apparatus that freely permits movement of panel members in response to thermal expansions and contractions of the panel members.

Another objective is to provide a method and apparatus for attaching a panel member to perimeter framing members that substantially minimizes the use of sealants and adhesives.

These and other objectives are addressed by the present invention. In one embodiment, the present invention provides an apparatus for attaching a panel member to a perimeter framing member that includes (i) a perimeter framing member having a first surface opposite a second surface to form a pocket for receiving an edge of the panel member; and (ii) an attachment member received between the first surface and one of the interior and exterior surfaces of the panel member. The attachment member causes one of the interior and exterior surfaces of the panel member to contact the second surface to hold the panel member in the pocket formed by the first and second surfaces. At least one of the first and second surfaces is located between the panel member and any adjacent panel member. The use of the attachment member to hold the panel member in the pocket substantially minimizes the use of mechanical fasteners, such as screws and bolts, and the use of sealants and adhesives to reduce seepage caused by mechanical fasteners.

The edge of the panel member refers to one or more of the sides of the panel member. Thus, a plurality of perimeter framing members are often employed, especially in dry systems, with at least one perimeter framing member being used for each side of the panel member.

The first and second surfaces can have different features to improve their ability to hold the panel member in position. At least one of the surfaces can be serrated to grip one of the panel member's interior and exterior surfaces. At least one of the surfaces can be grooved to form a passage to receive the attachment member. In this case, the adjacent panel member interior or exterior surface can also be grooved to define the passage. The matching grooves not only help hold the panel member in position but also align the panel member in the pocket.

The attachment member is preferably a substantially rigid, elongated rod. The attachment member preferably has a cross sectional area which closely approximates the cross-sectional area of the passage formed by the matching grooves so that the attachment member can firmly wedge the panel member against one of the pocket surfaces. At least one end of the attachment member can be tapered to facilitate insertion of the sometimes oversized attachment member in the passage. Unlike mechanical fasteners which are normally installed at frequent intervals, the attachment member provides a positive bond between the panel member and perimeter framing member because the attachment member typically extends the entire length of the perimeter framing member.

The perimeter framing member can include means to permit the apparatus to move relative to the attached stationary structural member in response to thermal expansion or contraction of the panel member. In this manner, the perimeter framing member can accommodate thermal contractions and expansions in the panel member without panel member failure and imprecision in the panel member dimensions during installation without discard of the panel member. Thus, the perimeter framing member allows for needed construction tolerances in fabrication and installation of the apparatus.

In another embodiment, the apparatus includes: (i) a panel member having an interior surface and an exterior surface; (ii) a perimeter framing member having opposing first and second surfaces for receiving therebetween the opposing interior and exterior surfaces of the panel member; and (iii) an attachment member received between the first surface and one of the opposing panel member surfaces. The attachment member causes one of the opposing panel member surfaces to contact the second surface to hold the panel member in the pocket and aligns the panel member in the pocket of the perimeter framing member upon insertion of the attachment member between the first surface member between the first surface and opposing panel member surface. The alignment causes the exterior panel member surface to be at a desired position relative to a selected object. In most cases, the selected object is the exterior surface of an adjacent panel member. Typically, it is desired that the exterior panel member surfaces be aligned such that they are substantially coplanar.

To permit four perimeter framing members to be attached to the four sides of the panel member, one of the perimeter framing members can have a plurality of spaced-apart, first surfaces to permit a plurality of attachment members to be received in the spaces located between the pairs of adjacent first surfaces.

A method is also provided for attaching the panel members to the perimeter framing member. The method includes the steps: (i) first placing an edge of the panel member in the pocket of the perimeter framing member; (ii) second positioning an attachment member between a surface of the panel member and a surface of the pocket to hold the panel member in the pocket; and (iii) third attaching the perimeter framing member to a building structural member. The method can include the step of bending the edge of the panel member. The steps (i) and (ii) can be repeated for each of the sides of the panel member.

The above-described apparatus is a relatively inexpensive means for attaching panel members to perimeter framing members. The simplicity of the steps to construct the apparatus permit unskilled laborers to assemble the apparatus at the job site. The simplicity results from the ability of the attachment member to automatically align the panel member in the pocket during reception of the attachment member by the passage and the substantial elimination of mechanical fasteners, such as screws and bolts, during assembly. The apparatus of the present invention further significantly reduces the use of expensive sealants and adhesives during assembly. Finally, the ability of the apparatus to permit movement of the panel member after installation significantly reduces costs from the need to replace panel members due to imprecisions during fabrication or panel member failure.

DETAILED DESCRIPTION

Figure 4:
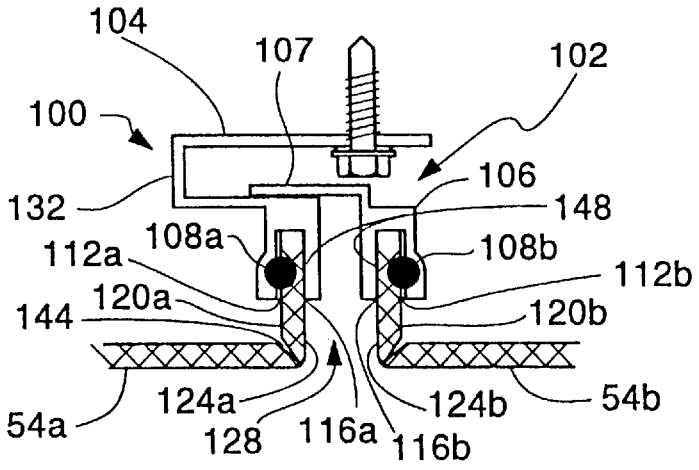
FIG. 4 depicts a first embodiment of the present invention showing the assembly of panel members to perimeter framing members.

FIG. 4 depicts two adjacent panel member assemblies 100, 102 and the attached panel members 54*a,b* according to a first embodiment of the present invention for use in a dry or wet system. The panel members can be composed of a variety of materials, including wood, plastics, metal, ceramics, masonry, and composites thereof. A preferred composite panel member 54*a,b* is metal- or plastic-faced with a wood, metal, or plastic core. A more preferred panel member is a composite of metal and plastics sold under the trademark "ALUCOBOND". The panel member assembly 100 attaches to the panel member 54*a* and includes a perimeter framing member 104 and an attachment member 108*a*. Panel member assembly 102 attaches to the panel member 54*b* and includes a perimeter framing member 106 and attachment member 108*b*. The perimeter framing members 104, 106 have opposing first and second surface surfaces 112*a,b* and 116*a,b* contact opposing interior and exterior surfaces 120*a,b* and 124*a,b* of the panel member 54*a,b* respectively, and thereby hold the panel member in position. The attachment member 108*a,b* is received in a passage formed by opposing grooves in the panel member 54*a,b* and first surface 112*a,b*. The matching grooves guide the attachment member 108*a,b* during assembly and ensure that the panel member 54*a,b* fits flush in the pocket formed by the first and second surfaces of panel member 54*a* such that the exterior surface of panel member 54*a* is substantially coplanar with the exterior surface of panel member 54*b*. The attachment member 108*a,b* exerts pressure on the interior surface 120*a,b* of the panel member 54*a,b* thereby forcing the exterior surface 124*a,b* of the panel member 54*a,b* against the second surface 116*a,b* and wedging the panel member 54*a,b* in position. The panel member assembly 100 can be used to support panel members in exterior or interior walls, ceilings, or roofs of a building structure.

The perimeter framing member can be formed or extruded from metal or plastics. To channel terrestrial fluids from the exposed joint 128 between the panel members 54*a,b* and inhibit air penetration, the perimeter framing members in a dry system enclose the entire length of each side of the panel member 54. In this manner, the fluids migrate along the joints between the panel members to the lower parts of the building for drainage.

The perimeter framing members 104, 106 each include an interlocking flange 107, 132. Interlocking flange 132 engages a structural member (not shown) permanently attached to the side of the building, and interlocking flange 107 movably engages the interlocking flange 132. The flanges facilitate fluid migration along the joints. As will be appreciated, the interlocking flanges 107, 132 can be in a variety of configurations depending upon a number of factors, including the type of system involved (i.e., wet or dry system), the ability of the panel member to be removed and/or replaced after installation, structural loadings on the interlocking flange due to winds, and the interlocking flange's location on the panel member relative to the interlocking flanges of adjacent perimeter framing members. By way of example, as shown in FIG. 4, the adjacent interlocking flanges 107, 132 of the various perimeter framing members on a panel member can have different configurations due to their different locations on the panel members.

The attachment member 108 is an elongated, cylindrical rod that is received in a cylindrically shaped passage extending the length of the side of the panel member received in the pocket. The attachment member can be a single piece extending the full or partial length of the passage or a multiplicity of pieces that have a total length equivalent to the passage length. The attachment member self aligns the panel member 54*a,b* with the perimeter framing member 104, 106 such that the exterior surface of the panel is substantially coplanar with the exterior surface of an adjacent panel and mechanically locks the perimeter framing member 104, 106 to the panel member 54 to hold the panel member in position. To apply a force against the interior surface 120 of the panel member 54 and thereby mechanically lock, seal, and align the panel member 54, the perimeter of the attachment member 108 has the same shape as the passage, but the attachment member has the same or a slightly larger cross-sectional area (normal to its longitudinal axis) than the cross-sectional area of the passage (normal to its longitudinal axis). Preferably, the cross-sectional area of the attachment member 108 is at least about 100% and more preferably ranges from about 100 to about 125% of the cross-sectional area of the passage.

Figure 9:
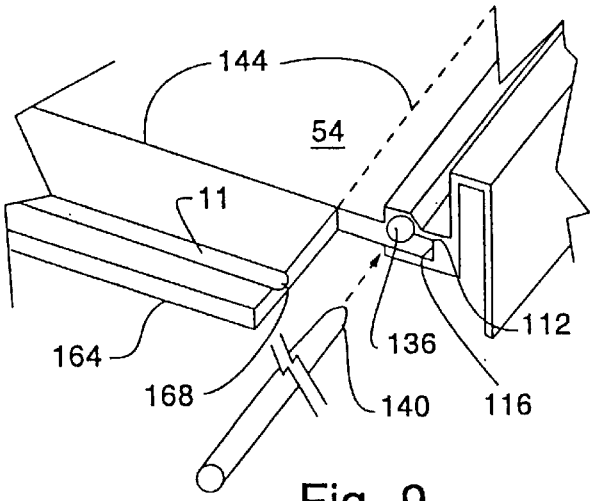
Figure 8E:
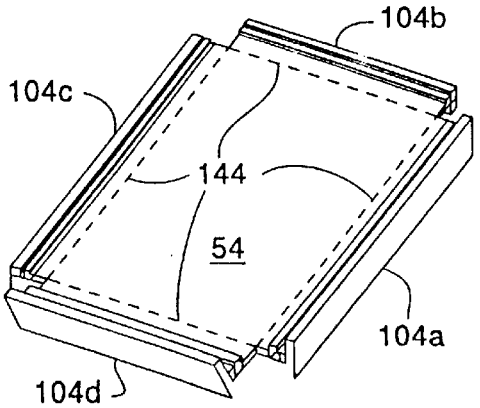

To permit the oversized attachment member 108 to be received in the passage 136, the attachment member 108, as depicted in FIG. 9, has a tapered end 140, with one portion of the tapered end having a cross-sectional area less than the diameter of the passage and another portion having a cross-sectional area equal to or greater than the diameter of the passage. In this manner, the attachment member 108 can be driven into the passage 136.

The attachment member 108 can be rigid or flexible depending on the application. Preferably, the attachment member is substantially rigid to permit it to be driven into the passage 136. The attachment member 108 can be composed of a variety of materials, including wood, metal, plastic, and composites thereof.

Figure 1:
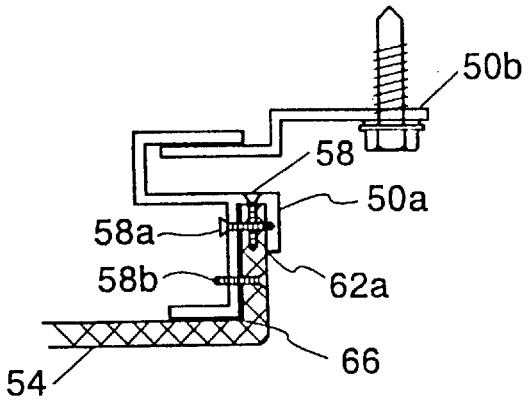
Fig. 1 PRIOR ART
FIGS. 1–3 depict various prior art apparatuses for attaching panel members to building structural members.
Figure 1B:
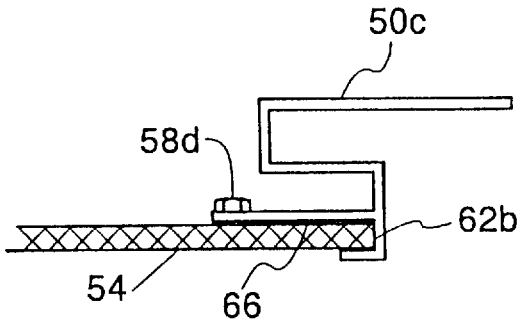
Fig. 1B PRIOR ART
Figure 1A:
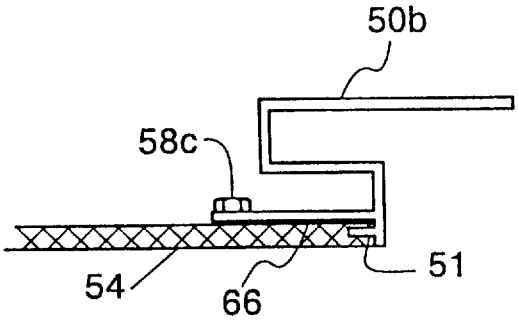
Fig. 1A PRIOR ART
Figure 1C:
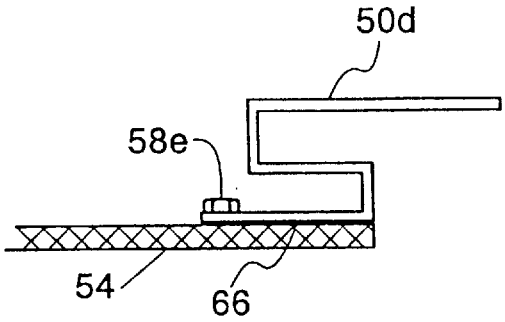
Fig.1C PRIOR ART
Figure 2:
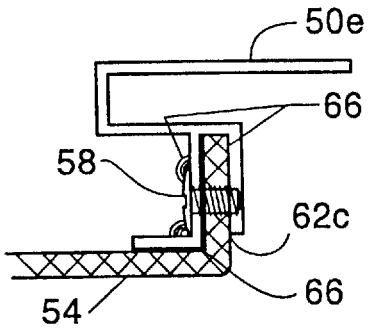
Fig. 2 PRIOR ART
Figure 3:
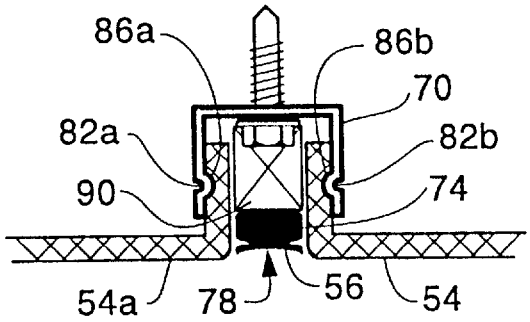
Fig. 3 PRIOR ART

Referring again to FIG. 4, the panel member 54 may have a notch 144 to permit each side to be bent as shown in FIG. 1 after attachment of the perimeter framing member. As will be appreciated, panel member 54 thickness can vary depending on its composition.

To prevent terrestrial fluids from migrating along the interface between the first and second surfaces 112, 116 and the edges of the panel member 54, a sealant 148 can be applied between the second surface 116 and exterior surface 124 of the panel member 54. The sealant 148 retards air and water migration and thereby prevents such fluids from contacting the attachment member 108 and the area behind the panel member 54, which can be highly susceptible to water damage.

Figure 5:
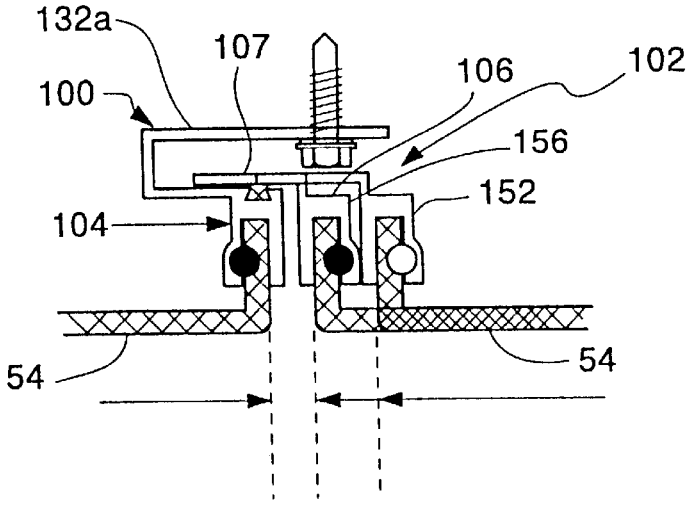
FIGS. 5–7 depict thermal expansions and contractions of the panel member in the first embodiment.
Figure 6:
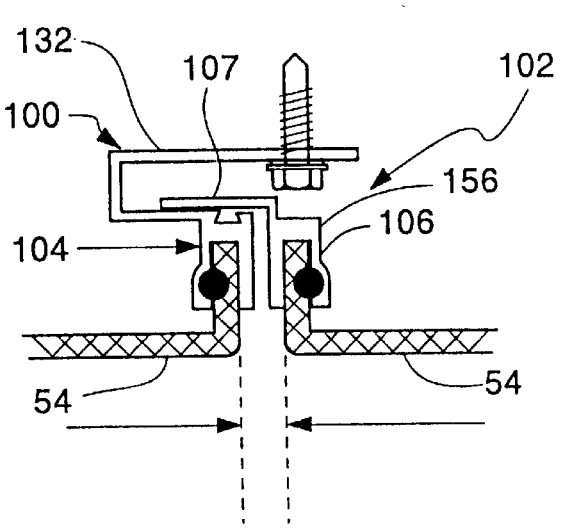
Figure 7:
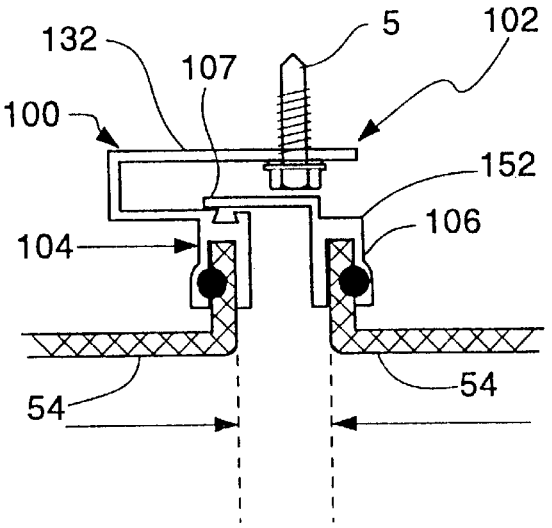

FIGS. 5–7 illustrate the mechanism by which the panel member assembly 100 absorbs either thermally or seismically induced movement of the panel member or building and fabrication imprecisions in the sizes of any of the components of the panel member assemblies or panel members. The mechanism absorbs thermal and seismic movements and inaccuracies by movement in the joint and not the panel member itself. Referring to FIGS. 5–7, through thermal or seismic expansion the panel member edge expands from a first position 152 to a second position 156. The interlocking flange 132 of the perimeter framing member 104 and the interlocking flange 107 of the perimeter framing member 106 of the adjacent panel member form male/female slip joints, permitting the perimeter framing member 107 to freely move relative to the stationary perimeter framing member 104 and thereby accommodate the thermal or seismic expansion without bending or warping of the panel member or undue stress at the panel corners. Referring to FIGS. 5 and 7, the thermal or seismic contraction of the panel member from the first to a third position 152 is similarly accommodated by the perimeter framing members 104, 106 with a minimum amount of stress on the panel member 54 and components of the panel member assembly 100. The movement of the adjacent perimeter framing members 104, 106 relative to one another also tolerates inaccurate measurements and cuts in the panel members and perimeter framing members during assembly.

Referring to FIGS. 8A–E and 9–11, the method to assemble the various components of the panel member assembly and attach the panel member assembly to the panel member will be explained. As will be appreciated, the order of certain steps can be different from that set forth below.

Figure 8A:
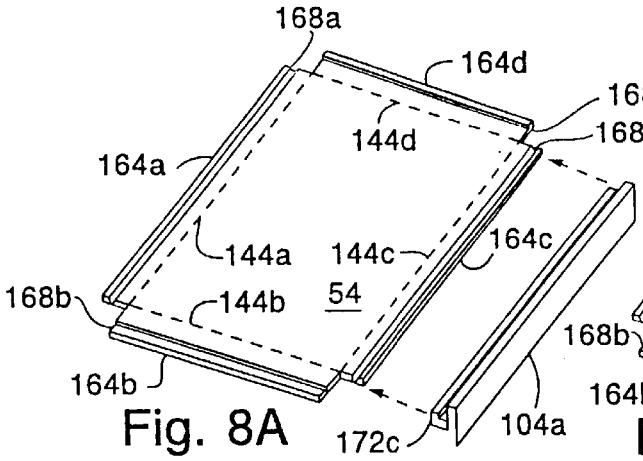
FIGS. 8A–E and 9–13A depict a method to assemble and install the first embodiment.
Figure 8B:
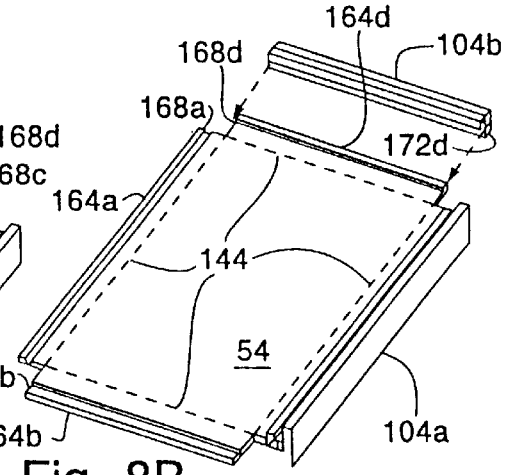
Figure 8C:
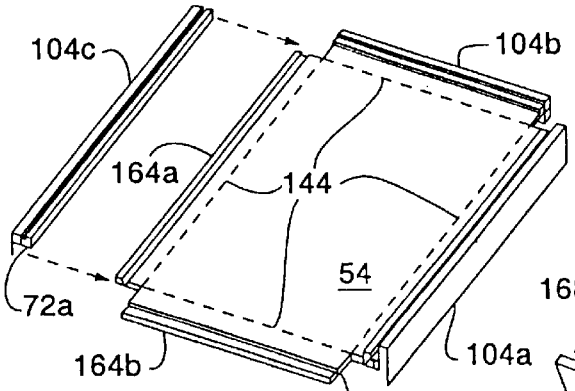
Figure 8D:
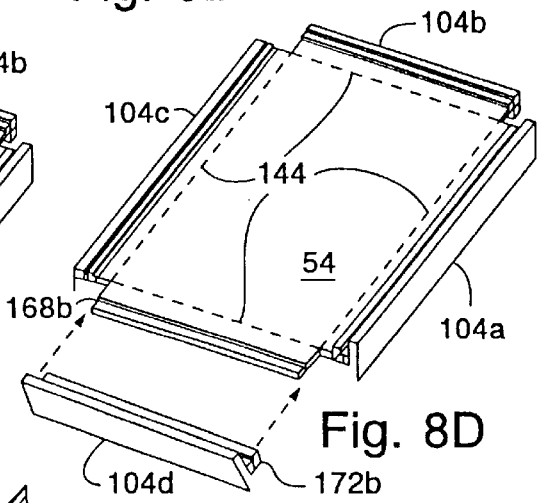

In a first step the panel member 54 is measured and cut as shown in FIG. 8A to form a plurality of sides 164*a–d,* and notches 144*a–d* are cut into the panel member 54 along the intended fold lines of the panel member 54. Grooves 168*a–d* are cut into the panel member 54 opposite the grooves 172*a–d* in the perimeter framing members 104*a–d* to receive the attachment members 108.

In a second step, a perimeter framing member is sequentially attached to each side of the panel member. To attach the perimeter framing member, a sealant 148 is applied to a panel member surface to be received in the pocket formed by the first and second surfaces and the groove 172*c* on the perimeter framing member is then aligned with the groove 168*c* on the side 164*c* of the panel member 54. The tapered end 140 of the attachment member 108 is inserted into the passage 136 formed by the opposing grooves, and the attachment member 108 is driven into position in the passage. These steps are repeated sequentially for each of the four sides of the panel member. Alternatively, two or more perimeter framing members can be aligned with the grooves in the panel member and the attachment members then sequentially inserted in each of the panel members.

Figure 10:
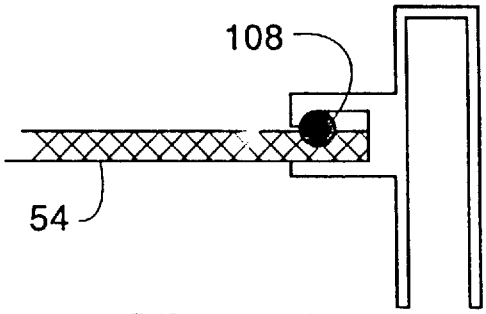
Figure 11:
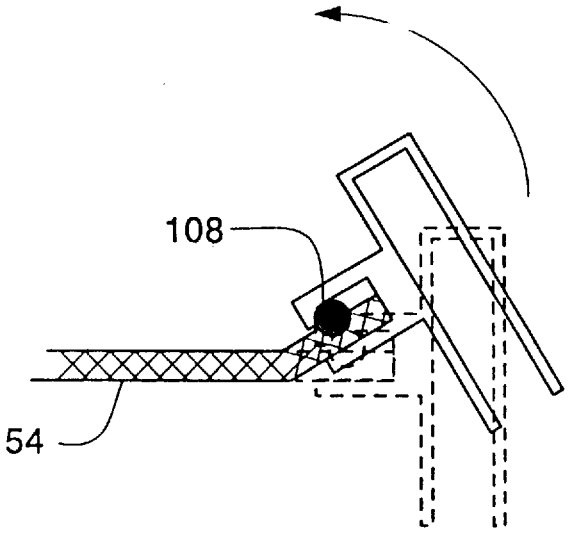

After the perimeter framing members are attached to each side of the panel member 54, the sides are bent along the notches 144*a–d* as shown in FIGS. 10–11. The ends of the adjacent perimeter framing members can be mated to one another by being cut at a 45° angle or notched. The ends can then be attached to one another by a gusset or one or more screws extending through the framing members into the panel member.

Alternatively, the perimeter framing members can be attached after the sides are bent along the notches 144*a–d*. This can be accomplished with relatively minor modifications to the panel member and perimeter framing members.

Figure 12:
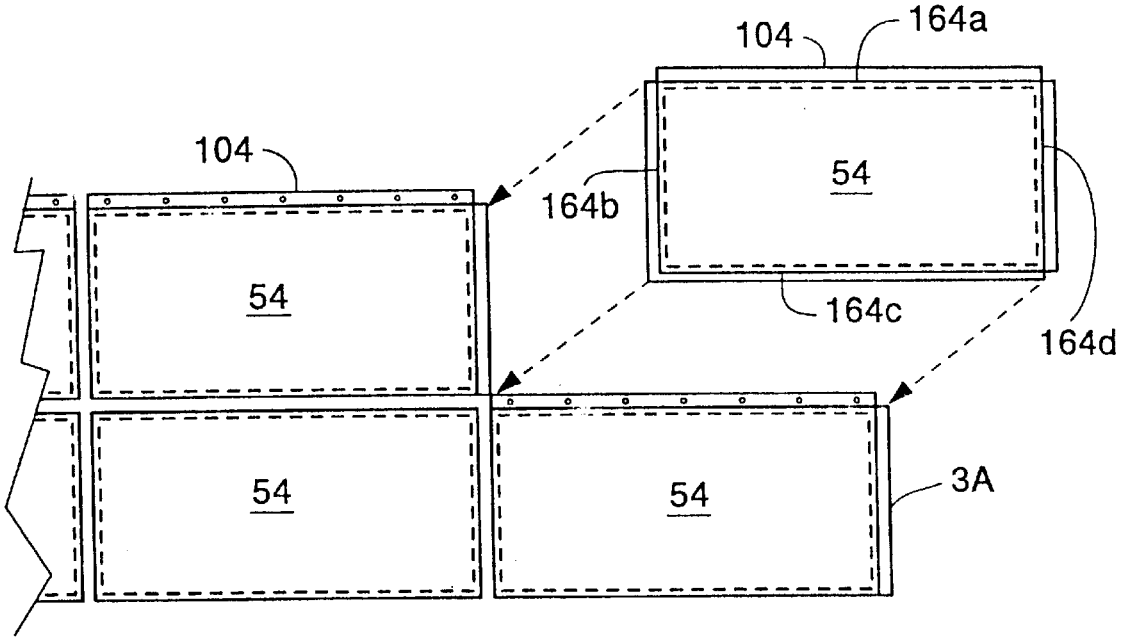
Figure 13:
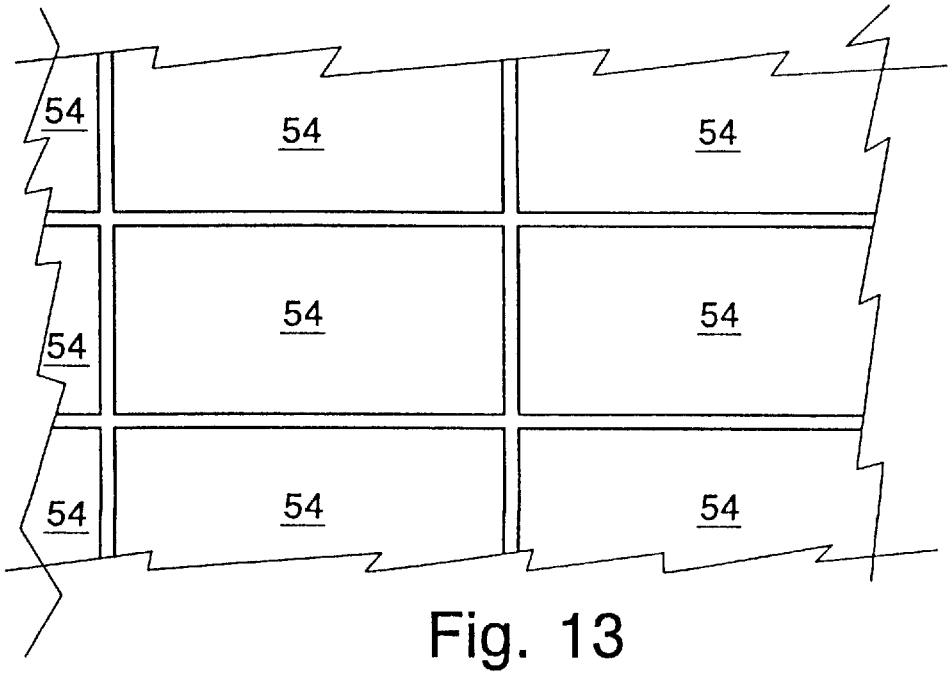
Figure 13A:
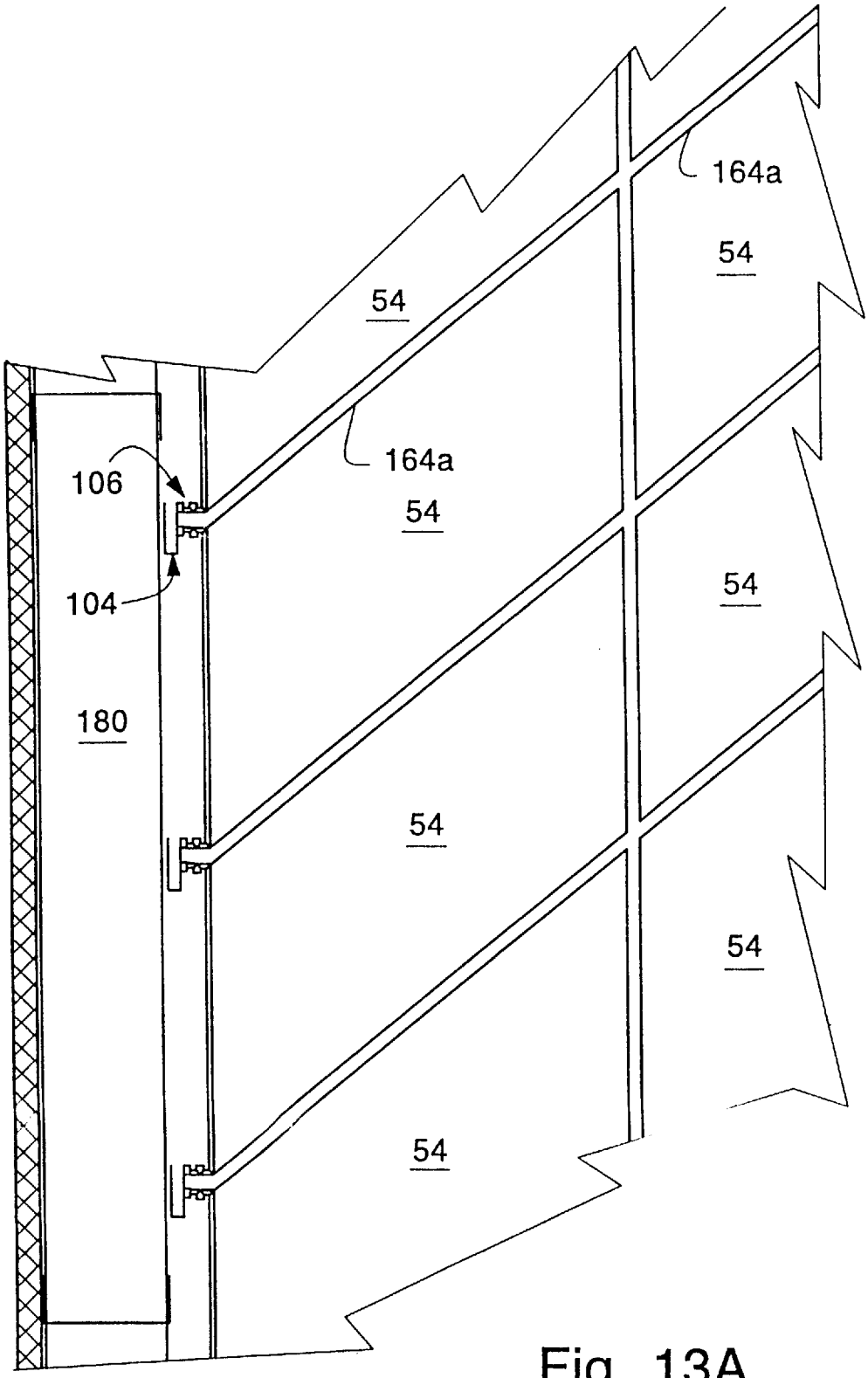

FIGS. 12, 13, and 13A depict one method of attaching of the panel members 54 and the attached panel members to the building structural members on the wall in a dry system. The perimeter framing member 104 on the upper side of each panel member assembly 100 is attached to a building structural member 180 with mechanical fasteners. As noted above, the interlocking flanges of the remaining perimeter framing members form male/female slip joints with the interlocking members of the perimeter framing members on the adjacent panel member assemblies and are thereby held in position. Accordingly, thermal expansion and contraction of the panel member is accommodated at movable sides 164*b–d* of the panel member assembly and not at its upper fixed side 164*a*. The completed wall is depicted by FIG. 13.

Another method for attaching the panel members 54 and the attached panel members to the building structural members is to first attach a "T"- or "I"-shaped component of the perimeter framing member to the building structural member. The "T"- or "I"-shaped component forms a male/female joint with the component of the perimeter framing member attached to the panel member. This method is known as the separated grid method.

Figure 14:
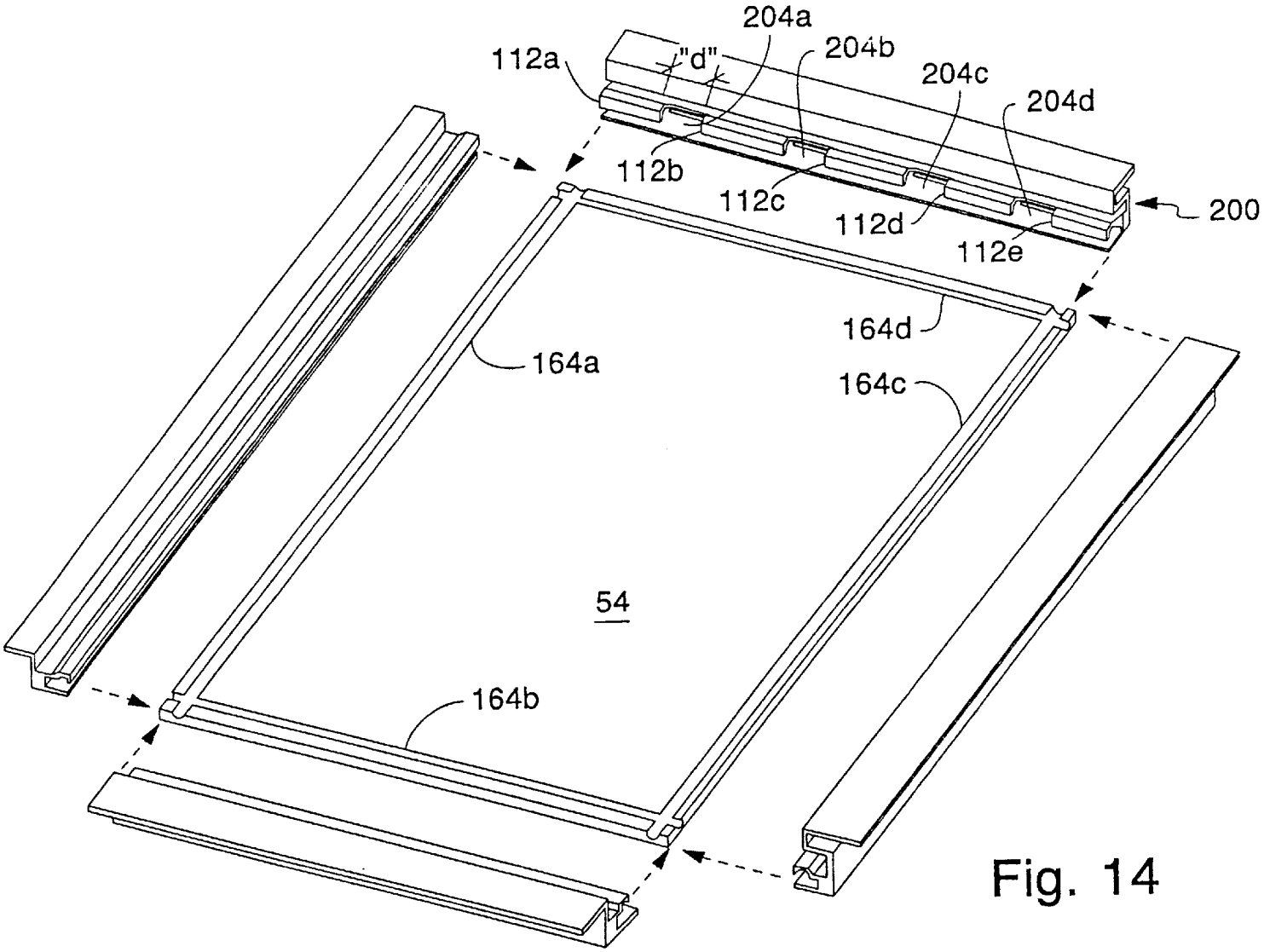
FIGS. 14–15 depict other methods to assemble the first embodiment.
Figure 15:
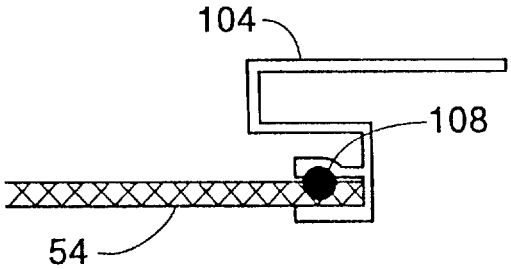

FIGS. 14–15 depict another method to assemble the panel member assembly 100 of the first embodiment and attach it to a panel member. In this configuration, the sides of the panel member are not bent after attachment of the perimeter framing members. Accordingly, continuous intermittent grooves, but no notches 120, are cut into the panel member. Perimeter framing members 200*a–c* are first sequentially attached to the panel member. To permit the remaining perimeter framing member 200*d* to be attached to the panel member, a number of spaced-apart first surfaces 112*a–e* are employed. The spaces 204*a–d* between adjacent first surfaces have a sufficient length to permit a plurality of attachment members to be received by the plurality of first surfaces. Normally, the distance "d" between adjacent first surfaces 112*a,b* is substantially the length of the attachment members to be inserted into the perimeter framing member via the corresponding space 204*a*. As will be appreciated, the already attached perimeter framing members prevent a single attachment member from being used to attach the perimeter framing member 200 to the panel member 54.

Figure 16:
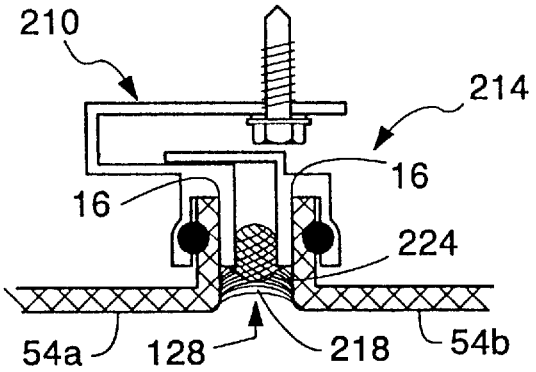
FIGS. 16, 16A and 17 depict a second embodiment of the present invention.
Figure 17:
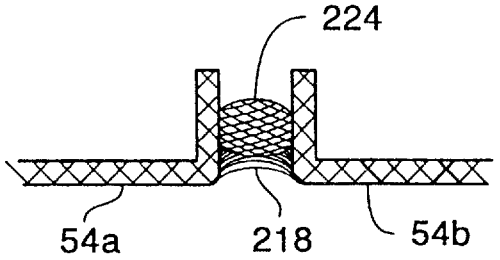
Figure 16A:
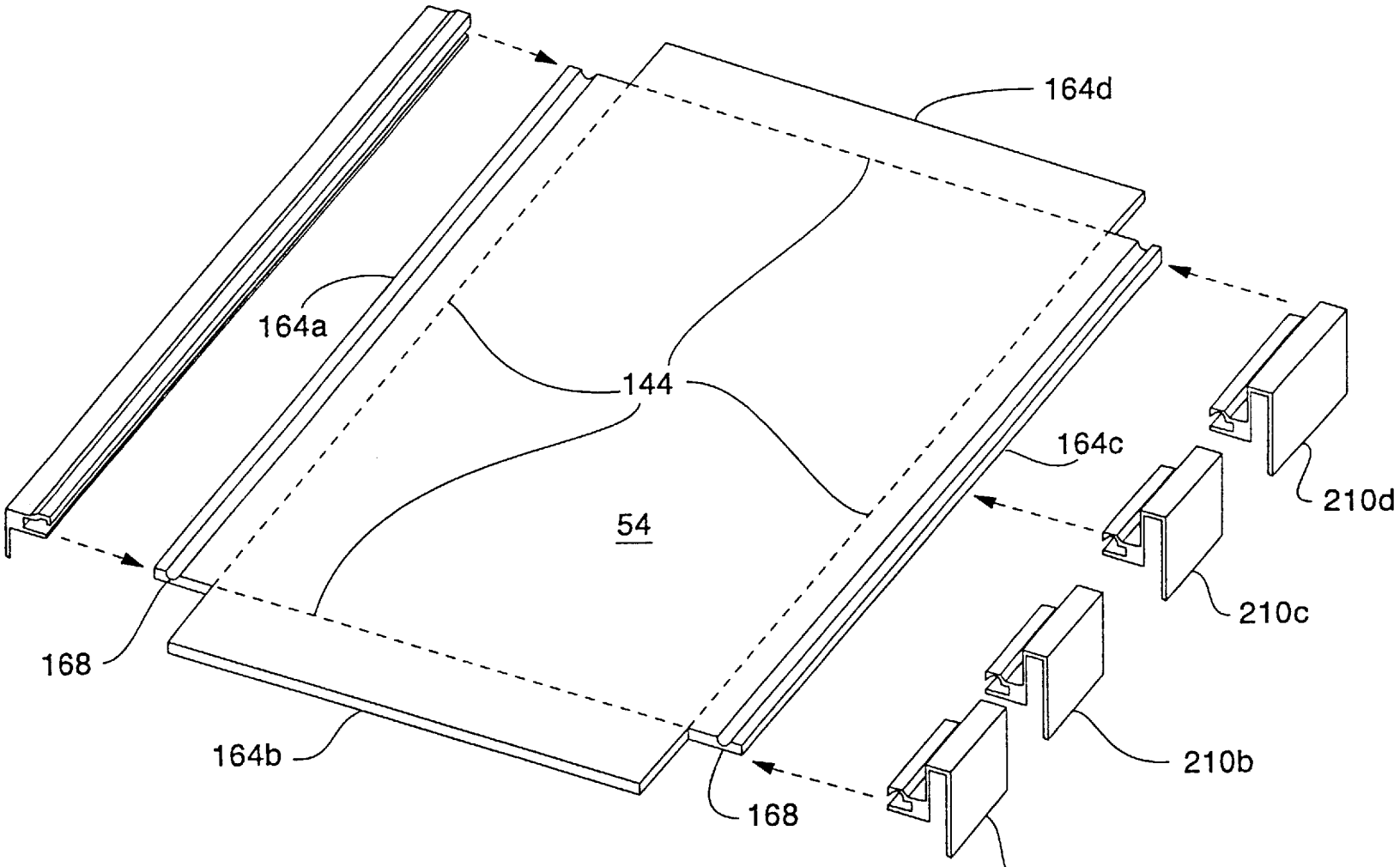

FIGS. 16–17 depict panel member assemblies 210, 214 according to a second embodiment of the present invention. The panel member assemblies are configured for use in wet systems. As shown in FIG. 16, the panel member assembly includes similar components as the panel member assemblies 100, 102 of the first embodiment except that a sealant 218 and a backing material 224 may be used to seal the joint 128. Unlike the first embodiment, as few as two continuous panel member assemblies can be mounted on the panel member sides with the remaining panel member sides having no attached panel member assemblies. Alternatively, one or more sides of the panel member can have a plurality of spaced-apart discontinuous panel member assemblies 210*a–d* as shown in FIG. 16A. These panel sides, as shown in FIG. 17, are sealed using gaskets and/or the sealant 218 and backing material 224.

Figure 18A:
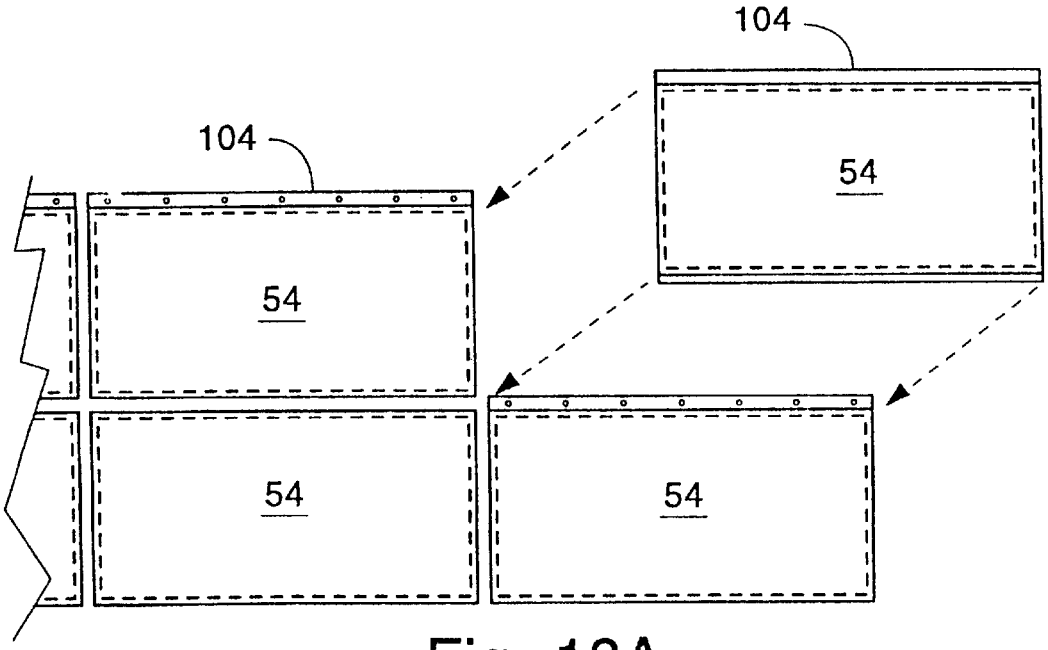
FIGS. 18–19A depict a method to assemble and install the second embodiment.
Figure 19:
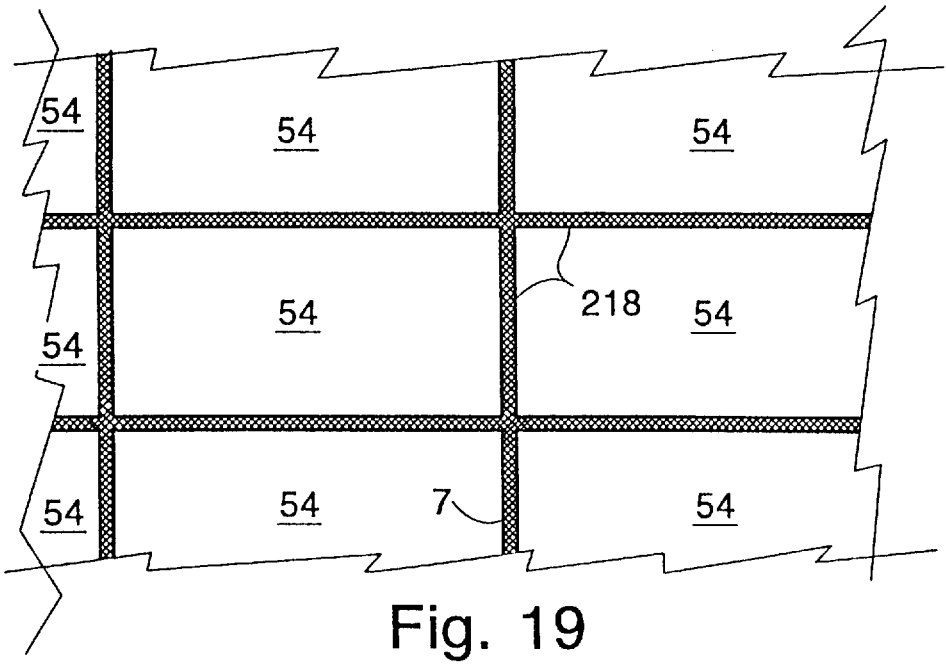
Figure 18:
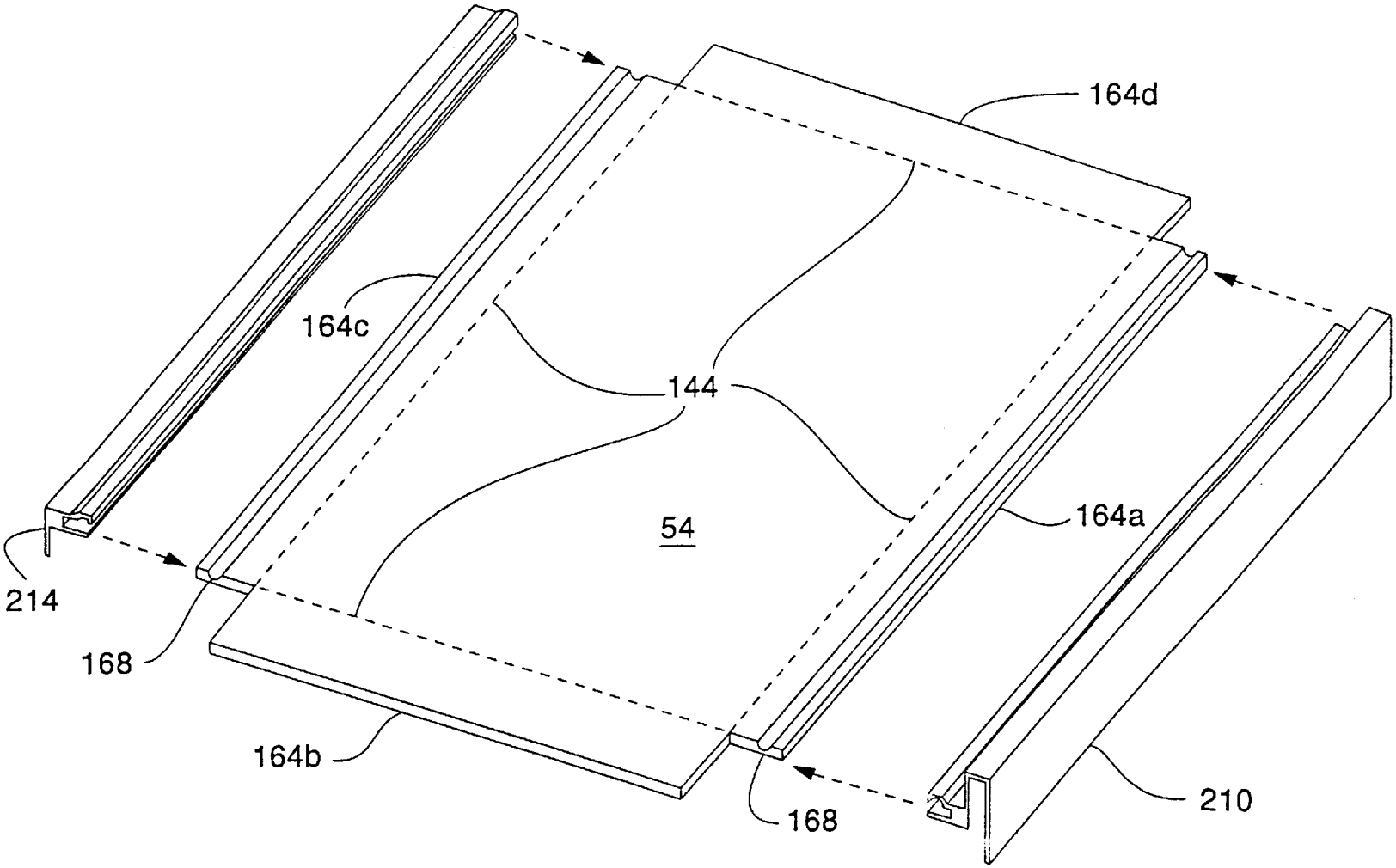
Figure 19A:
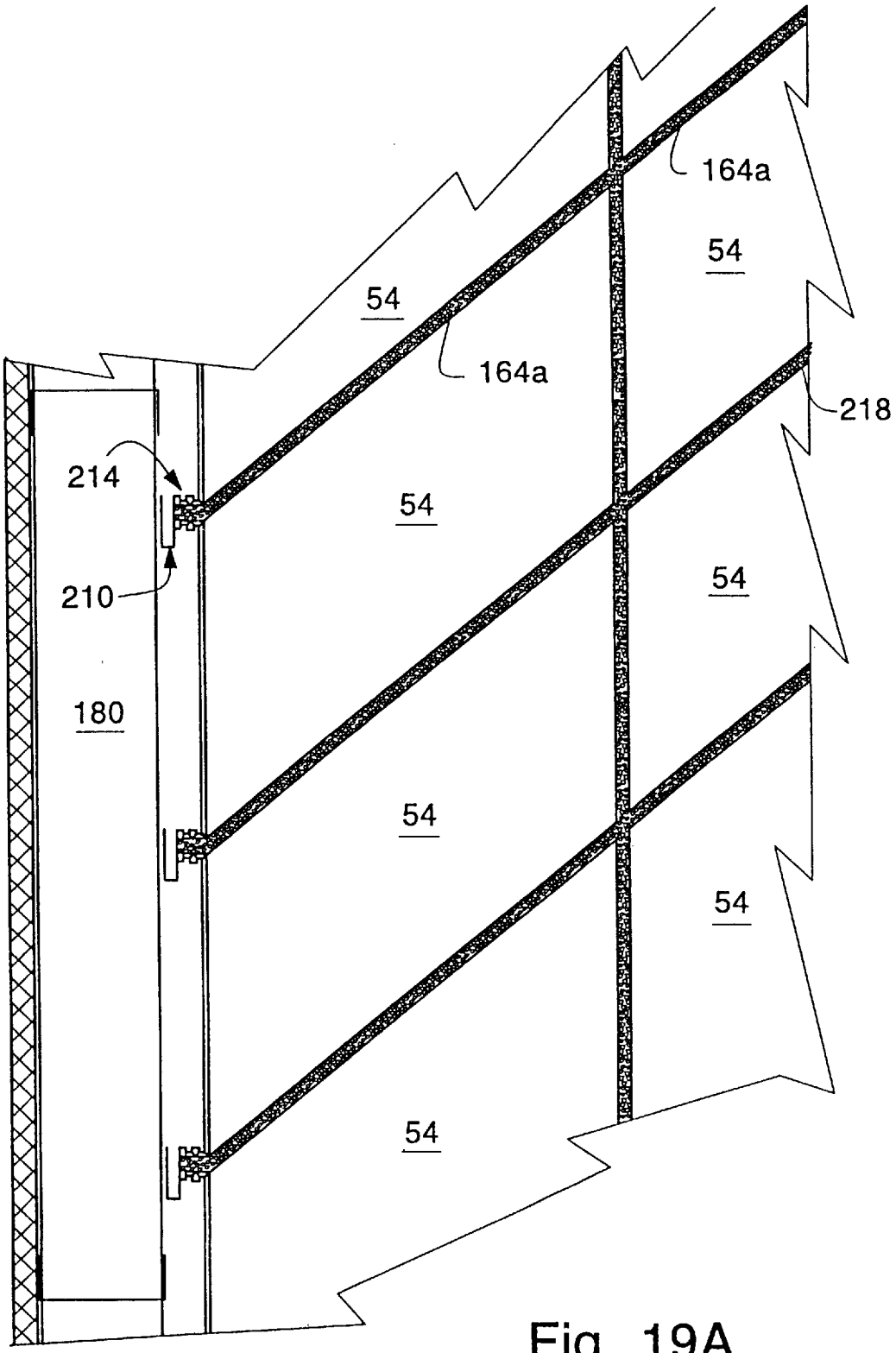

FIGS. 18, 18A, 19 and 19A depict the method to attach the panel member assemblies 210, 214 to the panel members and then to structural members on a wall. As shown in FIGS. 18 and 18A the opposing sides 164*a,c* but not the opposing sides 164*b,d* of the panel member have a panel member assembly. As in the first embodiment, only the upper side 164*a* of the panel member assembly 210 is attached to the structural member 180 using mechanical fasteners. The interlocking flange of the lower side 164*c* engage the interlocking flange of the adjacent panel member assembly as shown in FIG. 19A. After the panel member assemblies are attached to the structural members, the backing members (not shown) are placed in the joints and the sealant 218 is applied to the joints.

Panel member assemblies used in rain screen systems differ from the panel member assemblies used in wet systems only by the elimination of the backing material and sealant. Rain screen systems are used in situations where the panel member assemblies are being attached to a wall already impervious to penetration by air and water. Accordingly, no backing member and sealant 218 is applied in the joints between the adjacent panel member assemblies. However, like the wet system, rain screen systems have panel member assemblies on two or more sides of the panel member.

Figure 20:
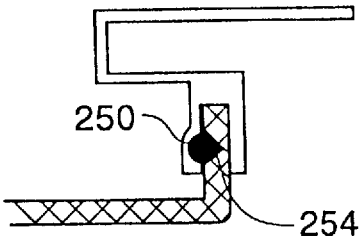
FIGS. 20–22 depict third, fourth, and fifth embodiments of the present invention based on different shaped attachment members.
Figure 21:
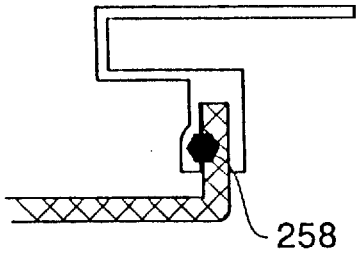
Figure 22:
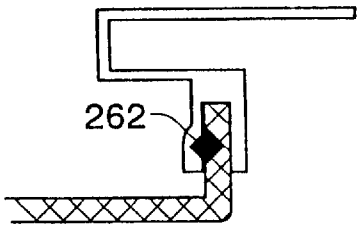

FIGS. 20–22 depict panel member assemblies according to third, fourth, and fifth embodiments of the present invention, respectively. The only difference from the panel member assemblies of the prior embodiments is in the shape of the attachment member 108. Each of the attachment members and passages of these embodiments have angular shapes to prevent rotation of the attachment member in the passage 136 after installation. The attachment member can have an irregular, angular shape such that such as that shown in FIG. 20. In FIG. 20, one portion 254 of the attachment member has a triangular shape and another portion 250 a circular shape. The attachment member can also be in symmetrical angular shapes, like those shown in FIGS. 21–22. As shown in FIG. 21, the attachment member 258 of the fourth embodiment has an octagonal shape, and as shown in FIG. 22, the attachment member 262 of the fifth embodiment a rectangular shape. As will be appreciated, a variety of other angular, circular, or irregular shapes can also be employed.

Figure 23:
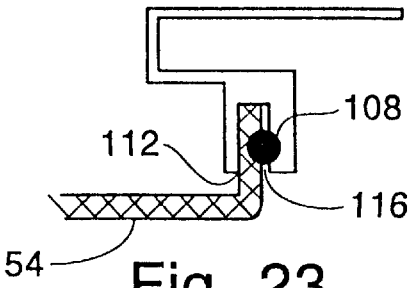
FIG. 23 depicts a sixth embodiment of the present invention.

FIG. 23 depicts a sixth embodiment of the present invention. The sixth embodiment differs from the previous embodiments in that the attachment member 108 is located between the second surface 116 of the perimeter framing member and the exterior surface of the panel member 54.

Figure 24:
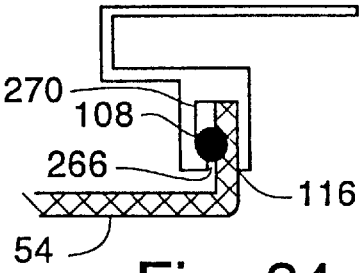
FIG. 24 depicts a seventh embodiment of the present invention.

FIG. 24 depicts a seventh embodiment of the present invention. The seventh embodiment differs from the first through fifth embodiments in that the perimeter framing member has no groove matching the groove in the panel member. Rather, the first surface of the perimeter framing member has a lip 266 and a channel 270 to contact only a portion of the attachment member 108. Another portion of the attachment member does not contact the perimeter framing member or panel member but is separated by a space 270 therefrom.

Figure 25:
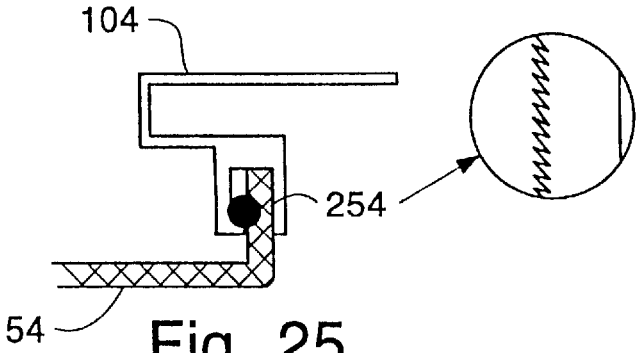
FIG. 25 depicts an eighth embodiment of the present invention.

Finally, FIG. 25 depicts an eighth embodiment of the present invention. The eighth embodiment differs from the first through fifth embodiments in that the second surface 274 has a serrated edge to more firmly engage the exterior surface of the panel member 54. The serrated edge will normally scall (i.e., roughen) the exterior surface of the panel member 54, which further decreases the likelihood that the panel member 54 will disengage from the perimeter framing member.

While various embodiments have been described in detail, it is apparent that modifications and adaptations of those embodiments will occur to those skilled in the art. However, it is to be expressly understood that such modifications and adaptations are within the scope of these inventions, as set forth in the following claims.

What is claimed is:

1. An apparatus for engaging a panel member, comprising:

adjacent first and second panel members, each having an interior surface and an exterior surface;

a perimeter framing member having adjacent first and second pockets for receiving a corresponding one of the first and second panel members, the first pocket being defined by opposing surfaces for receiving an edge of said first panel member therebetween, wherein at least one of said opposing surfaces is located between said first panel member and said second panel member and wherein said perimeter framing member is configured such that said first pocket has freedom of movement relative to said second pocket in response to thermal expansion and contraction of said first and second panel members; and an attachment member received between opposing surfaces and one of said interior and exterior surfaces of the first panel member, said attachment member causing one of said interior and exterior surfaces of said first panel member to contact one of said opposing surfaces to hold said first panel member between said opposing surfaces.

2. The apparatus of claim 1, wherein said edge is a side of said first panel member, said first panel member having a plurality of sides, and a plurality of said perimeter framing members contact said plurality of sides.

3. The apparatus of claim 1, wherein at least one of said opposing surfaces is serrated to grip one of said interior and exterior surfaces of said first panel member.

4. The apparatus of claim 1, wherein at least one of said first and second surfaces is grooved to receive said attachment member.

5. The apparatus of claim 1, wherein at least one of said interior and exterior surfaces of said first panel member is grooved to receive said attachment member whereby when the attachment member is received in the groove, the attachment member aligns the first panel member relative to the perimeter framing member.

6. The apparatus of claim 1, wherein one of said opposing surfaces and one of said interior and exterior surfaces of said first panel member form a passage of a size and shape to receive said attachment member in said passage and said attachment member aligns said first panel member relative to said perimeter framing member when said attachment member is received in said passage.

7. The apparatus of claim 6, wherein after the reception of said attachment member in said passage, said exterior surface of said first panel member is aligned relative to an exterior surface of said second panel member.

8. The apparatus of claim 1, wherein one of said opposing surfaces and one of said interior and exterior surfaces of said first panel member form a passage of a size and shape to receive said attachment member in said passage and said attachment member has a tapered end to facilitate the reception of said attachment member in said passage.

9. The apparatus of claim 1, wherein one of said opposing surfaces and one of said interior and exterior surfaces of said first panel member form a passage of a size and shape to receive said attachment member in said passage and said attachment member has a larger size than said passage to force said first panel member against one of said opposing surfaces.

10. The apparatus of claim 5, wherein the exterior surface of the first panel member is substantially coplanar with a second exterior surface of the second panel member.

11. The apparatus of claim 1, wherein said edge is a side of said first panel member and said perimeter framing member and said attachment member have substantially the same length as said edge.

12. The apparatus of claim 1, wherein said second pocket has opposing second surfaces and said opposing surfaces and opposing second surfaces are each defined by a corresponding projection from said perimeter framing member, each of said projections being different from one another.

13. The apparatus of claim 1, wherein one of said opposing surfaces and one of said interior and exterior surfaces of said first panel member form a passage to receive said attachment member and said attachment member has a complementary shape to said passage.

14. The apparatus of claim 1, wherein the second pocket is defined by second opposing surfaces and the opposing surfaces and second opposing surfaces are each defined by a different projection of the perimeter framing member.

15. The apparatus of claim 1, wherein the opposing surfaces of the pocket directly contact the interior and exterior surfaces of the first panel member.

16. The apparatus of claim 15, wherein the interface between the opposing surfaces and the interior and exterior surfaces of the first panel member are free of a sealant.

17. An apparatus for attaching to a panel member, comprising:

a panel member having an interior surface and an exterior surface, at least one of the interior and exterior surfaces having a notch;

a perimeter framing member having opposing first and second surfaces for receiving therebetween the interior and exterior surfaces of said panel member, wherein at least one of the first and second surfaces is located between the panel member and a second panel member adjacent to the panel member; and an attachment member received between said first surface and one of said interior and exterior panel member surfaces, said attachment member causing one of said interior and exterior panel member surfaces to contact said second surface to hold said panel member between the first and second surfaces, wherein said attachment member is received in the notch and wherein, when the attachment member is received in the notch, the attachment member aligns the panel member relative to the second panel member.

18. The apparatus of claim 17 wherein the exterior surface of the panel member is substantially coplanar with a second exterior surface of the second panel member.

19. The apparatus of claim 17, wherein said first and second surfaces contact a side of said panel member and said perimeter framing member extends substantially the length of said side and a plurality of first surfaces are located along said length to permit a plurality of attachment members to be received in a plurality of said spaces.

20. The apparatus of claim 19, wherein the distance between adjacent first surfaces is no less than the length of at least one of said attachment members.

21. The apparatus of claim 17, wherein said panel member has four sides and each side contacts a perimeter framing member.

22. The apparatus of claim 17, wherein said attachment member is located between one of said interior and exterior panel member surfaces and said first surface to protect said attachment member from exposure to fluids in the terrestrial environment.

23. The apparatus of claim 17, wherein said attachment member has a cross-sectional area that ranges from about 100% to about 125% of the cross-sectional area of said space.

24. The apparatus of claim 17, wherein after the reception of said attachment member in said notch, said exterior surface is aligned relative to an exterior surface of an adjacent panel member.

25. A method for attaching a panel member to a building member, comprising the steps of:

first placing an edge of a panel member in a pocket defined by opposing surfaces of a perimeter framing member;

second positioning an attachment member between a surface of said panel member and one of the opposing surfaces of said pocket to align said panel member in said pocket; and third attaching said perimeter framing member to a building member.

26. The method of claim 25, further comprising after said second positioning step: bending said edge of said panel member.

27. The method of claim 25, further comprising before said third attaching step:

repeating each of said first placing and second positioning steps for each of a plurality of edges of said panel member.

28. The method of claim 25, wherein at least one of the opposing surfaces is located between the panel member and an adjacent panel member.

* * * * *

UNITED STATES PATENT AND TRADEMARK OFFICE

CERTIFICATE OF CORRECTION

PATENT NO. : 5,809,729
DATED : September 22, 1998
INVENTORS : MITCHELL

It is certified that error appears in the above-identified patent and that said Letters Patent is hereby corrected as shown below:

In Claim 1, col. 9, line 57, insert after "between" and before "opposing" --one of said--.

Signed and Sealed this

Fourth Day of April, 2000

*Attest:*

Q. TODD DICKINSON

*Attesting Officer*

*Director of Patents and Trademarks*